US011448416B2

(12) United States Patent
Jacoby

(10) Patent No.: US 11,448,416 B2
(45) Date of Patent: Sep. 20, 2022

(54) HEATING AND COOLING SYSTEM

(71) Applicant: Joseph Jacoby, Maple Shade, NJ (US)

(72) Inventor: Joseph Jacoby, Maple Shade, NJ (US)

( * ) Notice: Subject to any disclaimer, the term of this patent is extended or adjusted under 35 U.S.C. 154(b) by 0 days.

(21) Appl. No.: 17/592,987

(22) Filed: Feb. 4, 2022

(65) Prior Publication Data

US 2022/0252294 A1 Aug. 11, 2022

Related U.S. Application Data

(60) Provisional application No. 63/147,423, filed on Feb. 9, 2021.

(51) Int. Cl.

| | |
|---|---|
| ***F24F 11/76*** | (2018.01) |
| ***F24F 8/00*** | (2021.01) |
| ***F28D 20/00*** | (2006.01) |
| ***F24D 11/00*** | (2022.01) |
| ***F24F 110/10*** | (2018.01) |

(52) U.S. Cl.

CPC ..... *F24F 11/76* (2018.01); *F24D 11/006* (2013.01); *F24F 8/00* (2021.01); *F28D 20/00* (2013.01); *F24F 2110/10* (2018.01); *F28D 2020/0065* (2013.01)

(58) Field of Classification Search

CPC ..... B64D 13/08; B64D 2013/0655; F24F 5/0085; F24F 8/00; F24F 11/76; F28D 2020/0082; F28D 2020/0065; F28D 20/00; F24D 11/006

See application file for complete search history.

(56) References Cited

U.S. PATENT DOCUMENTS

| | | | | |
|---|---|---|---|---|
| 1,336,901 | A | 3/1920 | Handelan | |
| 2,216,350 | A | 10/1940 | McElgin | |
| 2,268,048 | A | 12/1941 | McElgin | |
| 2,286,749 | A | 6/1942 | McElgin | |
| 2,290,985 | A | 7/1942 | McElgin | |
| 4,203,485 | A | 5/1980 | Zilbermann et al. | |
| 5,348,078 | A | 9/1994 | Dusbane et al. | |
| 5,373,987 | A | 12/1994 | Corabatir | |
| 5,983,890 | A | 11/1999 | Thomas et al. | |
| 6,792,766 | B2 | 9/2004 | Osborne et al. | |
| 7,261,241 | B2 | 8/2007 | Eoga | |
| 7,565,225 | B2 | 7/2009 | Dushane et al. | |
| 7,716,943 | B2 | 5/2010 | Seefeldt | |
| 7,837,128 | B2 | 11/2010 | Helt et al. | |
| 8,190,273 | B1 * | 5/2012 | Federspiel | F24F 11/30 700/17 |

(Continued)

FOREIGN PATENT DOCUMENTS

| | | | |
|---|---|---|---|
| CN | 204403771 U | * | 6/2015 |
| CN | 107192286 A | * | 9/2017 |

(Continued)

OTHER PUBLICATIONS

CN-204403771-U Translation (Year: 2015).*

(Continued)

*Primary Examiner* — Schyler S Sanks
(74) *Attorney, Agent, or Firm* — Volpe Koenig

(57) ABSTRACT

A heating and cooling system or temperature control system is disclosed herein that generally stores very hot air and very cold air, and selectively disperses or releases the hot or cold air using a control assembly.

18 Claims, 14 Drawing Sheets

(56) References Cited

U.S. PATENT DOCUMENTS

| | | | |
|---|---|---|---|
| 9,134,715 | B2 | 9/2015 | Geadelmann et al. |
| 2002/0102936 | A1 | 8/2002 | Daumier |
| 2009/0032604 | A1 | 2/2009 | Miller |
| 2009/0065595 | A1 | 3/2009 | Kates |

FOREIGN PATENT DOCUMENTS

| | | | | | |
|---|---|---|---|---|---|
| CN | 109094375 | A | * | 12/2018 | ..... B60L 3/00 |
| JP | 2008516179 | A | | 9/2005 | |

OTHER PUBLICATIONS

CN-107192286-A Translation (Year: 2017).*
CN-109094375-A Translation (Year: 2018).*
"High-Performance HVAC"—Fine Homebuilding <https://www.finehomebuilding.com/2019/03/07/high-performance-hvac-2>; retreived from Internet Archive Wayback Machine <https://web.archive.org/web/20190727061459/https://www.finehomebuilding.com/2019/03/07/high-performance-hvac-2>; Published on Jul. 27, 2019 (7 pages).
"How Does a Zoned Heating/Cooling System Work?" Service Champions; <https://www.servicechampions.net/blog/how-does-a-zoned-heatingcooling-system-work/> Published on Sep. 22, 2012 (4 pages).

* cited by examiner

HEATING AND COOLING SYSTEM

INCORPORATION BY REFERENCE

This application claims the benefit of U.S. Provisional Patent Application No. 63/147,423, which was filed on Feb. 9, 2021 and is incorporated herein by reference in its entirety.

FIELD OF INVENTION

This invention is generally related to a heating and cooling system, and is more specifically related to a high heat and super cooling system that uses pressurized air.

BACKGROUND

In known heating and cooling systems, a central furnace can be provided that generally uses gas, electric, or oil to heat air within a plenum space. Ductwork is provided that generally distributes air through an enclosure, such as a house or other building. A fan or air distributor can be provided in these systems to circulate hot air to various regions or rooms in the enclosure. The hot air then passes through a vent or register in each of the rooms.

In one aspect, a central thermostat is generally provided that controls when the heater turns on and delivers hot air to all of the regions or rooms in the enclosure. This arrangement creates problems due to some rooms requiring more or less heat than other rooms. Rooms generally do not require the same amount of heat, and these systems are susceptible to overheating or underheating certain rooms.

Additionally, known central heating or cooling systems are relatively expensive to operate due to these inefficiencies. One reason for inefficiencies is due to thermal losses within the ductwork that direct the hot or cold air.

It would be desirable to provide a more efficient heating and cooling system that addresses these inefficiencies, among other issues.

SUMMARY

Briefly stated, an improved heating and cooling system is disclosed herein. In one aspect, the system includes a compressor, a first air tank and a second air tank, a heating assembly configured to heat air within the first air tank, a cooling assembly configured to cool air within the second air tank, a plurality of conduits to deliver air from the first air tank and the second air tank to a respective plurality of diffusers, and a control assembly configured to selectively release hot or cold air via the plurality of diffusers.

The control assembly can include a single thermostat or a plurality of thermostats, and a plurality of solenoids. The thermostat or thermostats are configured to drive the plurality of solenoids between open and closed positions such that hot or cold air is dispersed within an enclosure. In one aspect, each room or space in a dwelling can include a thermostat that is individually controlled and operated such that each room or space can selectively receive hot or cold air using the system described herein.

The heating assembly can include a high heat electric coil and a voltage source in one aspect. The cooling assembly can include any one or more known types of coolants, in one aspect. In one aspect, the cooling system includes a cryocooler component.

The cooling assembly can also include a drying unit configured to remove moisture from the air within the second tank.

In one aspect, the plurality of diffusers are arranged adjacent to existing vents, registers or other air dispersion components in the enclosure.

The system generally allows for hot pressurized air to be stored within the first tank and a first set of the plurality of conduits, and cold pressurized air to be stored within the second tank and a second set of the plurality of conduits. In one aspect, the air stored in the tanks is stored at approximately 150 psi.

In another aspect, the pressurized air provided by the pressurized air units can be maintained at 500 psi.

Preferred arrangements with one or more features of the invention are described below and in the claims.

BRIEF DESCRIPTION OF THE DRAWINGS

The foregoing summary as well as the following detailed description will be best understood when read in conjunction with the appended drawing. In the drawing.

DETAILED DESCRIPTION OF THE PREFERRED EMBODIMENTS

Figure 1:
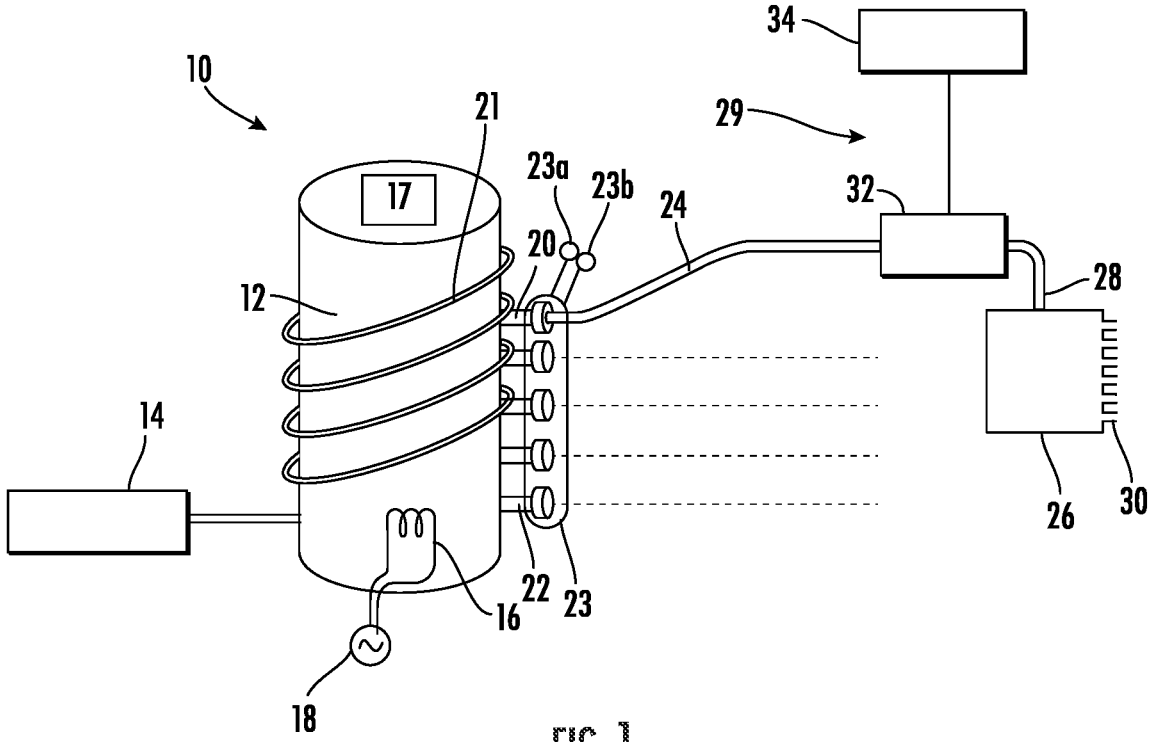
FIG. 1 is a schematic view of a heating assembly according to one aspect.

Certain terminology is used in the following description for convenience only and is not limiting. The words "inner," "outer," "inwardly," and "outwardly" refer to directions towards and away from the parts referenced in the drawings. A reference to a list of items that are cited as "at least one of a, b, or c" (where a, b, and c represent the items being listed) means any single one of the items a, b, c or combinations thereof. The terminology includes the words specifically noted above, derivates thereof, and words of similar import.

A high efficiency heating and cooling system is disclosed herein. In one aspect, the system includes a centralized high-pressure assembly that is configured to distribute the heat through various portions of a building, house, dwelling, or warehouse (generically referred to as an enclosure hereinafter).

In one aspect, the system provides the ability to direct constant, reliable, and consistently hot air to all regions of the enclosure. The system includes a high temperature pressurized assembly comprising a pressurized hot air assembly and a high temperature heater. As used herein, the term high heat or high temperature means a temperature of at least 500° F. in one aspect. In another aspect, the term high heat means a temperature of at least 700° F. One skilled in the art would understand that the temperature of the air can vary. In one aspect, the hot air is stored at approximately 350° F.-700° F. In one aspect, the high temperature air is released by the system at intervals according to a detected existing temperature. Short intervals of air can be released for extreme hot air, while longer intervals of air can be released for lower temperature air. As the released air mixes with ambient air, the air exiting the diffusers will approximately be slightly above room temperature.

A high efficiency cool air system is also disclosed herein. In one aspect, the system includes a super cooling pressurized vessel. In a combination system, a first vessel stores high pressure heated air that is released in small quantities through piping that is configured to keep the air at approximately 2-5 psi to any rooms that require heating. As the heating system releases hot air and pressure is lowered, the main compressor reintroduces air to be heated by the heating element, such as an electric heater, to maintain high efficiency. In one aspect, the heating element can include a threading of electrically powered coiled wire through a metal sheath and/or insulation. Electrical current can be applied to the coil to generate heat, which can heat the air within the tank or vessel. The heating element can include an electric tubular heater, such as a Calrod tubular heater. The heating element can generally include an electric heating coil encased in some type of insulation and/or piping. The air being released by the system can include low or high heat, depending on the surrounding climate of the spaces to be heated. This system allows for optimal time to store heat that will carry through the periods of a day that are colder. In one aspect, the heating unit, such as a Calrod heater, can be energized or powered using solar panels. Other power sources can be used.

In the combination system, a second vessel or tank is also provided that is generally configured to provide cool air. In one aspect, the second vessel or tank includes refrigerant. Piping, ventilation, or other ducts can be provided that are connected to the second tank and direct cooled air to specific rooms or spaces at intervals. As air exits the second vessel, a main compressor can be configured to reintroduce air to be cooled down.

In one embodiment, the coolant for the cooling system and has an operating temperature of −40° F. The term super cooling as used herein means a temperature of less than −20° F. in one aspect. In another aspect, the term super cooling means a temperature of less than −40° F. In one aspect, freon, cryocooler fluids, such as helium, or any other coolant can be used as the cooling source.

Based on the high heat and super cooling embodiments described herein, the assembly provides a highly efficient configuration for heating or cooling an enclosure. The system disclosed herein can be used or installed as a standalone system, or can be used in conjunction with preexisting air circulating systems.

Referring to the drawings, a heating system 10 is disclosed in FIG. 1. The system 10 includes a high-pressure tank 12, which is fed air via a compressor 14. In one aspect, the tank 12 can include a ceramic, coated vessel configured to withstand extreme heat and pressure. The compressor 14 is configured to pressurize air within the tank 12. In one aspect, the compressor 14 pressurizes the air within the tank 12 such that the operating pressure is at least 150 psi. In another aspect, the pressurized air is provided at least at 100 psi. One of ordinary skill in the art would understand that the air exiting the diffusers and being released into the dwelling is released at a much lower pressure, such as 1-5 psi. This pressure differential can be due to a pressure regulator, as described in more detail herein. The ambient air in the dwelling mixes with the highly heated or highly cooled are to exist the diffuser at slightly above or below the ambient temperature (i.e. +/−5° F. to 10° F. from ambient temperature).

Air in the tank 12 can be heated via a heating element 16. The heating element 16 can include heating coils 16 which are powered by a voltage or power source 18. In one aspect, solar energy, such as solar panels, can be used to power the heating element 16. In one aspect, a charging unit can be supplied that powers the heating element 16. Batteries can also be implemented with the heating element 16 to provide a reliable power source.

In one aspect, the heating element 16 is an electric tubular heater, such as a Calrod heater. Multiple heating elements can be provided. In one aspect, the heating element 16 is configured to be heated to at least 700° F. The heating element 16 can be configured to be heated to greater than 700° F. In one embodiment, the heating element 16 is configured to be heated to 1000° F. Sensors, valves, and other safety components can be implemented with the tanks or heating or cooling unit described herein.

A sensor 17 can be arranged within the tank 12 or in communication with the tank 12. In one aspect, the sensor 17 is configured to detect pressure and temperature of the air within the tank 12. Based on this information, the sensor 17 can indicate to a controller or other program unit to increase or decrease a heating or cooling function, increase or decrease pressure, and adjust any other parameters related to the system.

Figure 2:
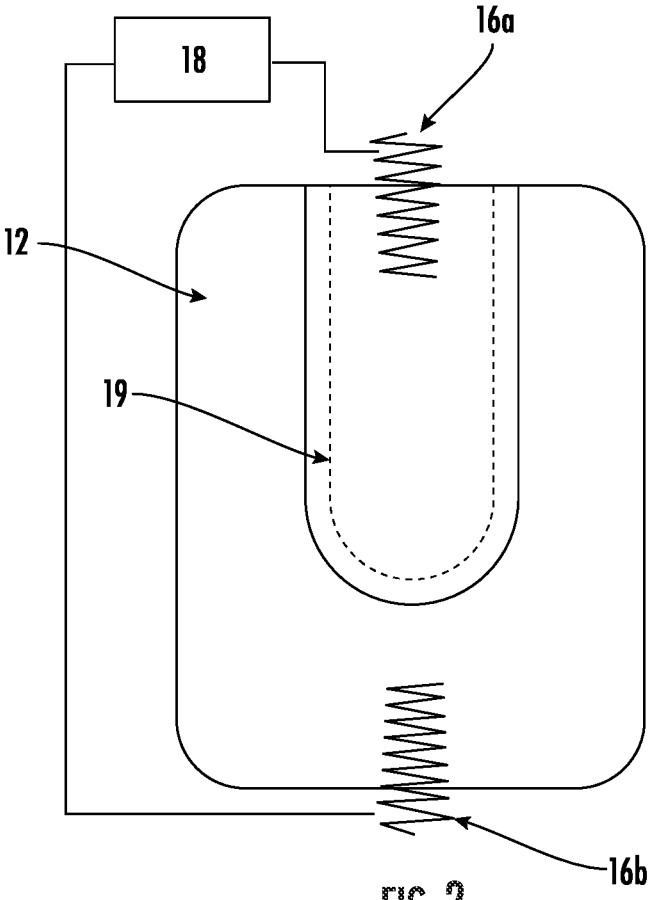
FIG. 2 is a magnified view of a heating element and tank from the heating assembly of FIG. 1.

FIG. 2 illustrates one aspect of a heating configuration for use with the tank 12. As shown in FIG. 2, a secondary container, enclosure, or tank 19 can be provided within the tank 12. As shown in FIG. 2, at least two heating elements 16*a*, 16*b* can be provided. The secondary container 19 can enclose one or more of the heating elements 16*a*, 16*b*. One skilled in the art would understand that the configuration shown in FIG. 2 is just one example of a heating configuration, and multiple heating elements may be arranged within the tank 12.

The tank 12 includes a manifold that is generally configured to direct hot air from the tank 12 to regions or rooms of an enclosure. In one aspect, the manifold includes a plurality of outlet pipes or tubing (i.e. conduits), which are illustrated as elements 20 and 22 in FIG. 1. In one aspect, the plurality of pipes includes a sufficient quantity of pipes to provide hot or cold air to each of the rooms in an enclosure. In one aspect, air from the tank 12 is fed to each of the rooms via a pipe or tube 24. In one embodiment, the pipe or tube 24 has an inner diameter of at least 0.5 inches. One skilled in the art would understand that the inner diameter of the pipe or tube 24 can be greater or smaller than 0.5 inches.

The pipe or tube 24 can include a conduit configured to direct hot or cold air, and is preferably insulated such that thermal losses are minimized. Accordingly, the air stored within the pipe or tube 24 can remain dormant and either very hot (i.e. roughly 400° F.) or very cold (i.e. roughly −100° F.) until it is needed to be released to adjust the temperature in a given room or space. One of ordinary skill in the art would understand additional insulation or less insulation may be used depending on the specific requirements for a heating or cooling system. In one aspect, the insulated pipe or material can be provided in roll form and can operate at working temperature of at least 500° F.

Each pipe or tube 24 terminates with a diffuser 26. The term diffuser as used herein refers to any air circulating or spreading element, such as a disperser, valve, or other conduit that is configured to release air. The diffuser can be selectively actuated such that air is released on command. For purposes of FIG. 1, only a single diffuser 26 is illustrated but one skilled in the art would understand that diffusers 26 would be provided in each room or region of the enclosure. In one embodiment, each diffuser 26 is positioned adjacent to or within an existing vent or register. In one aspect, existing ducts within the enclosure are configured to be continually fed with a low volume ambient air that is continuously recirculated by a low volume fan (shown schematically in FIG. 5A as element 40). The flow of air to the ducts can be selectively controlled via a controller element, such as solenoid 32. In one aspect, the fan 40 is centrally located relative to the enclosure and is configured to provide equal distribution of ambient air throughout the building. The fan 40 can be configured to provide circulation to an entire house or dwelling. Additional components, such as HEPA filters for dehumidifiers, humidifiers, and other air movers or fans can be provided for reintroduction of outside air if the desired to supplement heating and cooling. The fan 40 can be configured to be continuously operating and provide a low volume air circulation to provide fresh, clean air to accommodate any high heat or high cooling fusion.

The diffusers 26 can be arranged within a predetermined distance of an existing duct terminal end, vent, or register. In one aspect, the predetermined distance is approximately one foot, and can be eight inches to sixteen inches. This ensures that the pressurized high heat air from the assembly 10 is mixed with ambient circulating air from the existing duct, thereby ensuring that the high heat air is circulated throughout the room or region. This predetermined spacing between the diffuser 26 and duct opening or exit also ensures that air exiting the diffuser 26 is mixed and cooled such that air exiting the duct is not uncomfortably warm or hot. In one aspect, the diffuser 26 is located behind an existing vent or register that is already located in the room. In newly constructed dwellings or enclosures, the diffuser 26 can be installed directly within, next to, or in the vicinity of a vent or register. The diffuser 26 can include an inlet 28 and a plurality of smaller outlets 30 for distributing the pressurized air from the tank 12.

In order to retrofit an existing heating and cooling system, the diffusers 26 can be located behind a vent or register in the ductwork. In a standalone configuration or a new installation, a low-pressure air circulating system (including fan 40 and associated ducts, tanks, etc.) can be provided to direct air from a central plenum to each of the rooms. In this configuration, instead of ductwork, a pipe can be led from a central air circulating location to each of the rooms and diffusers 26. In one aspect, the pipe has a three-inch internal diameter. Air is generally circulated at relatively low pressure to each of the rooms in order to help disperse the hot air or cold air exiting from the diffusers 26.

Figure 7:
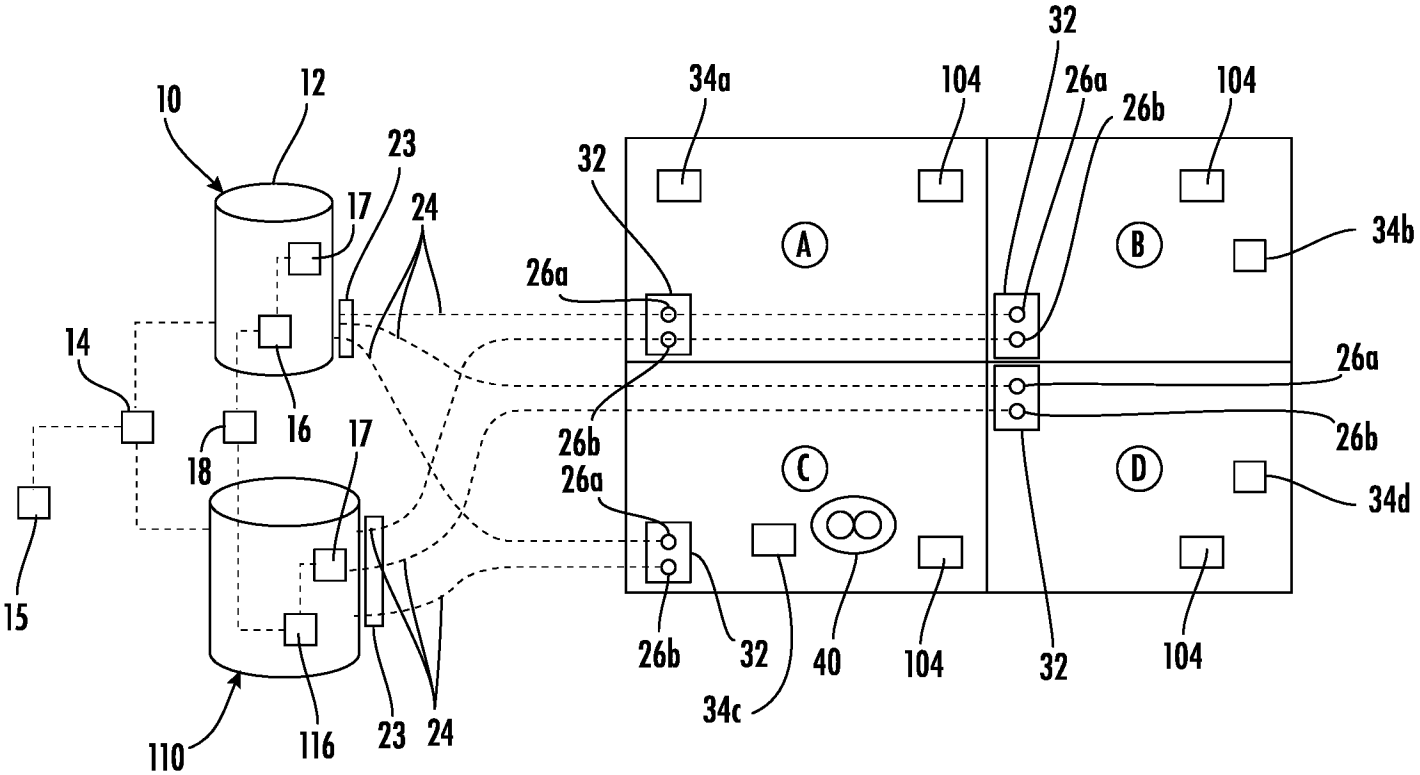
FIG. 7 illustrates an exemplary schematic diagram for a heating and cooling system.

A control assembly 29 can generally be included adjacent to the diffusers 26. In one aspect, the control assembly 29 includes at least one solenoid 32 and at least one thermostat 34. The solenoid 32 and the thermostat 34 are connected with each other (i.e. electrical connection, wireless connection, etc.) such that the thermostat 34 is configured to control the operation of the solenoid 32. The at least one solenoid 32 can include a plurality of solenoids, and the at least one thermostat 34 can include a plurality of thermostats. For example, as shown in FIG. 7, one thermostat 34*a*, 34*b*, 34*c*, 34*d* can be assigned or designated for each space, room, or area in a dwelling (i.e. rooms A, B, C, D). The thermostats 34*a*, 34*b*, 34*c*, 34*d* can be independently operated and each include sensors to detect the ambient temperature. Based on this detected temperature, the solenoids or air distribution in each space can be independently controlled such that the system is more efficient than known heating and cooling systems.

Each of the solenoids 32 and thermostats 34 can be arranged in a separate room or region, in one aspect. Alternatively, there can be one central thermostat 34 configured to control multiple solenoids 32. The thermostat 34 can be controlled by direct user engagement or wirelessly or remotely via a smartphone, remote control, or other component. The control assembly 29 generally controls the opening and closing of the solenoid 32 based on settings of the thermostat 34. When the solenoid 32 is opened, hot air is driven from the tank 12 through pipes or tubing 20, 22, 24 and through the open solenoid 32, through the inlet 28 of the diffuser 26 and ultimately out from the outlet 30. In one aspect, the solenoid 32 can be variably opened such that an amount of air exiting the diffuser 26 can be variably adjusted. The solenoid 32 and the control assembly 29 can be configured to automatically regulate heat distribution by detecting the temperature in a specific room and then opening the solenoid 32 if the temperature drops below a predetermined threshold. In one aspect, the thermostat 34 is configured to control operation of the heating element, and is also configured to receive data or information from any sensors, such as sensor 17. One of ordinary skill in the art would understand that baffles, fans, blades, or other diffusing structure can be implemented with the diffuser 26 to help further distribute the heated or cooled air.

Figure 3:
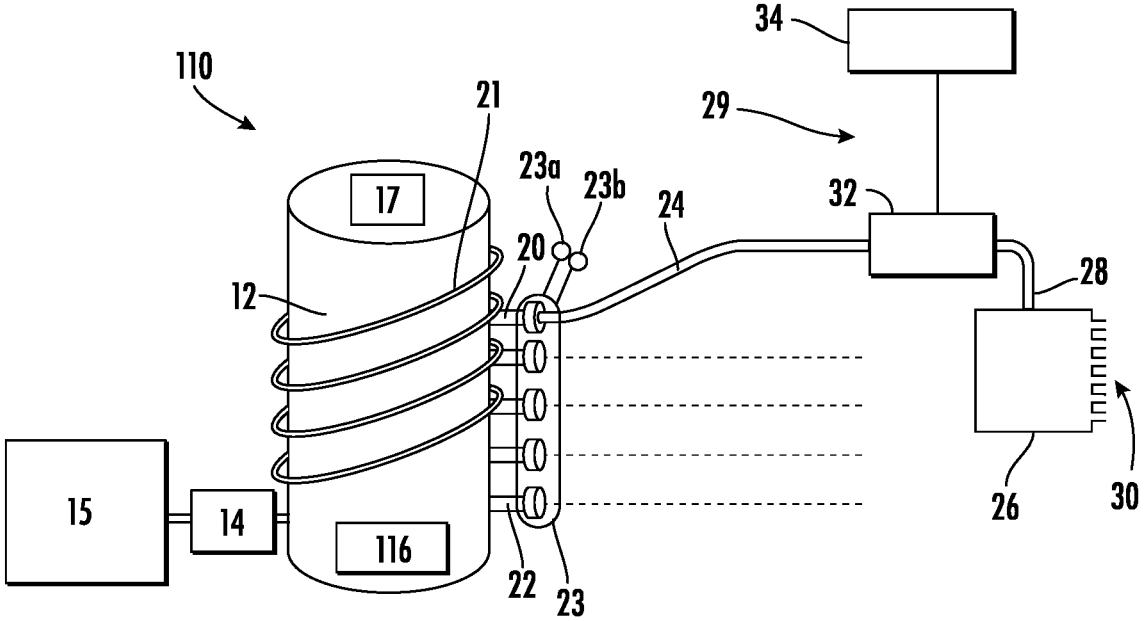
FIG. 3 is a schematic view of a cooling assembly according to one aspect.

A similar configuration is disclosed herein for providing cold air instead of hot air, as shown by the assembly 110 of FIG. 3. In one aspect, the system includes both a heating configuration and a cooling configuration. The two configurations can each include a separate tank or vessel, and the two tanks or vessels can be positioned adjacent to each other. Common components could be used by both system, such as a thermostat, compressor, or other element that is utilized for both heating and cooling.

The assembly 110 is similar to assembly 10 of FIG. 1 unless differing features are specified herein. The assembly 110 creates cold air via a refrigeration element 116. In one aspect, the refrigeration element 116 comprises cryocooler fluids, such as helium, freon or other coolant. The refrigeration unit can be self-contained and cooled, and continually used. Any type of super cooling refrigeration configuration can used, such as a closed loop including other cooling material or a refrigerant circuit assembly. One skilled in the art would understand based on this disclosure that any other means for cooling the air to a very low temperature can be used. The tank 12 includes cold air at a very high pressure (due to compressor 14), which is distributed to various rooms or regions via a manifold. The other features, such as the control assembly 29, solenoid 32, thermostat 34, diffuser 26, etc., all operate in the same manner as described with respect to FIG. 1.

A drying unit 15 can also be arranged within the assembly 110 and is configured to remove any moisture or condensation from the air entering the tank 12. The drying unit 15 can be a compressed air dryer, and may include a heat exchanger or condenser to condense moisture and remove it from the assembly. One of ordinary skill in the art would understand that a dehumidifier and dryer can be provided in both tanks of the present system to prevent introduction of humidity or moisture.

In one aspect, the system disclosed herein uses a cryocooler as the cooling or refrigeration unit 116 and/or as the heating unit 16. In one aspect, the cryocooler can be a Stirling cycle cryocooler. One of ordinary skill in the art would understand a cryocooler or similar cooler can include a voltage source or power source that powers an engine to transfer motion into transfer of heat. Electricity can be applied to a stator assembly to create a magnetic field, thereby causing a piston to oscillate. This movement can create a pressure or cyclical wave that moves a displacer or compressor. Movement of the piston and displacer can be controlled to expand or compress a working gas, such as helium, which is also referred to as a cryocooler substance or working fluid. The working fluid can be provided in sealed chambers. Based on the relationship between volume, temperature, and pressure (i.e. the ideal gas law), movement of the piston causes the temperature of the gas to either rise or lower. A heat sink for absorbing heat from the cryocooler, and/or a cooling plate for absorbing cold air from the cryocooler can be implemented with the tanks 12, 112 disclosed herein. One of ordinary skill in the art would understand that other types of cryocoolers or refrigeration and heating units can be used.

In one aspect, an external heating or cooling element 21 can be provided around the tanks 12, 112. For example, external heating or cooling element 21 can be configured to either heat or cool the tank 12, 112 to ensure that air within the tank 12, 112 is maintained at the desired temperature. These coils 21 can provide a pre-heating or pre-cooling element, i.e. a secondary heating or cooling element, for the tank 12, and can be integrated within a wall, sleeve or other portion of the tank 12. The coils 21 can be configured to prevent sudden introduction of hot or cold air coming from the main compressor into either one of the tanks.

Figure 4A:
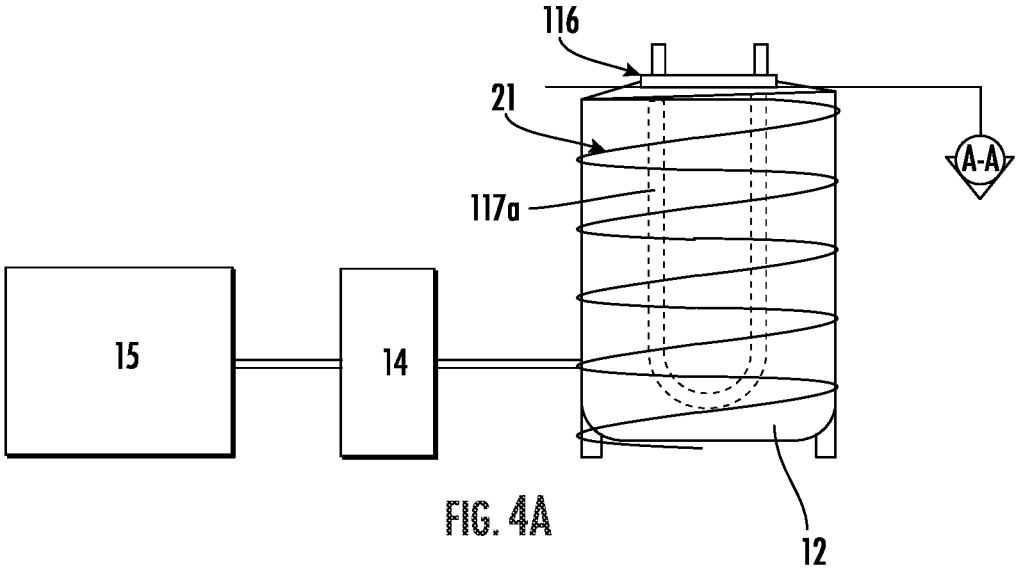
FIG. 4A is another view of a cooling element and tank from the cooling assembly of FIG. 3.
Figure 4B:
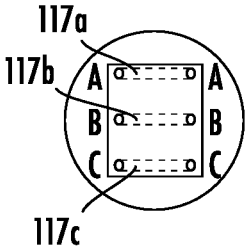
FIG. 4B is a cross-sectional view through line A-A of FIG. 4A.

FIGS. 4A and 4B illustrate further aspects of the assembly 110, and specifically show the compressor 14, drying unit 15, tank 12, and refrigeration unit 116. As shown in FIGS. 4A and 4B, the refrigeration unit 116 can include a manifold system including a plurality of coils. In one aspect, the refrigeration unit 116 includes a refrigerant, such as freon circulating through coils. The refrigeration unit 116 can alternatively include a cryocooler substance, such as helium, and produce cold air. One of ordinary skill in the art would understand that other refrigerants could be used. The refrigeration unit 116 can include a manifold system. A closed refrigerant circuit can be provided to store coolant and continuously circulate the coolant in order to cool the air in the tank. As shown in FIGS. 4A and 4B, a plurality of U-shaped tubes or containers 117*a*, 117*b*, 117*c* can be provided that each include the coolant or refrigerant, such as freon, or other known cooling material. The U-shaped tubes 117*a*, 117*b*, 117*c* can be independently removed, refilled, and replaced.

Figure 5A:
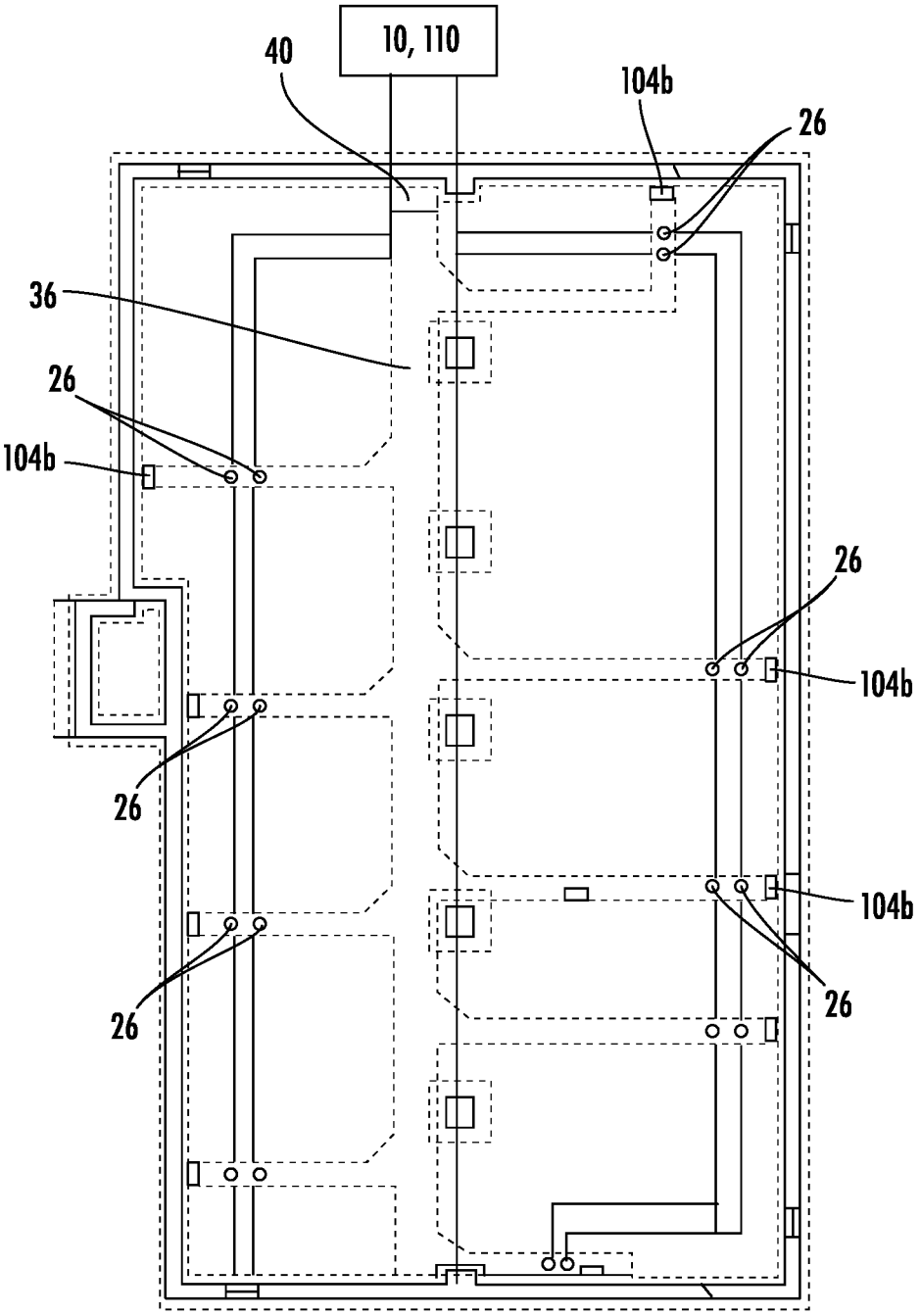
FIGS. 5A and 5B are schematic floor plans including the heating assembly of FIG. 1 and the cooling assembly of FIG. 3.

FIG. 5A is a schematic drawing showing the assemblies 10, 110 commonly integrated within an enclosure. A plurality of diffusers 26 are arranged in individual rooms or regions of the enclosure. The diffusers 26 are positioned generally adjacent to existing registers in the ductwork 36 (shown in dashed lines in FIGS. 5A and 5B) of the enclosure. The diffusers 26 are integrated into duct work of the main HVAC system, and are shown in more detail in FIGS. 6A-6F.

As disclosed herein, the assemblies 10, 110 provide an arrangement in which hot air and cold air is contained within associated tanks, pipes, and other conduits, and a control assembly generally controls distribution of said hot air and cold air via a plurality of diffusers. The hot and cold air are both held stationary within the respective systems until needed. The hot and cold air can be stored within the systems and remain dormant for extended periods of time without experiencing thermal losses. Insulation and other thermal loss preventative measures can be implemented with the tanks, the conduits, or any other aspect of the assemblies 10, 110 such that air within the assemblies 10, 110 can be reliably maintained at high and low temperatures.

Figure 5B:
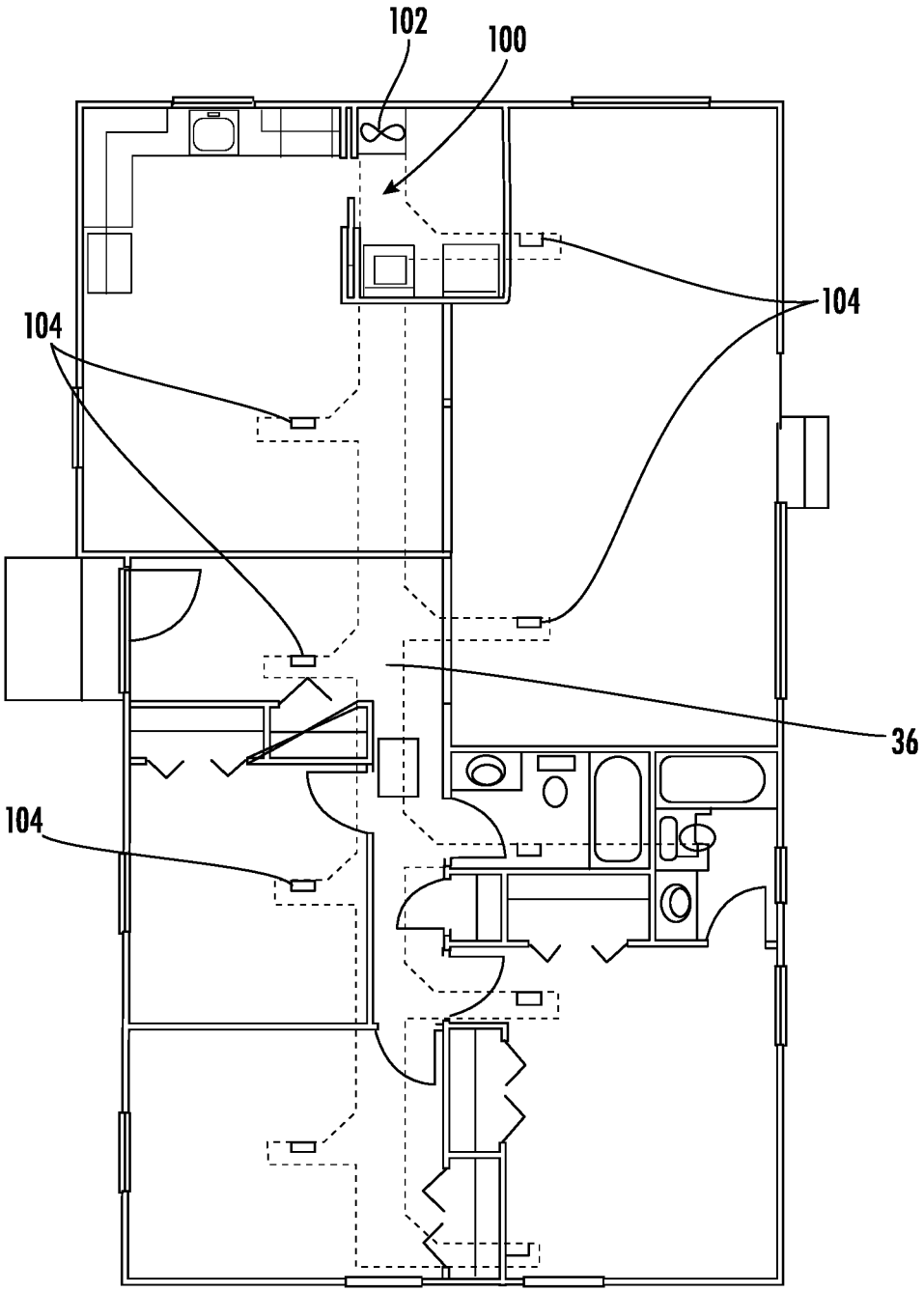
Figure 6A:
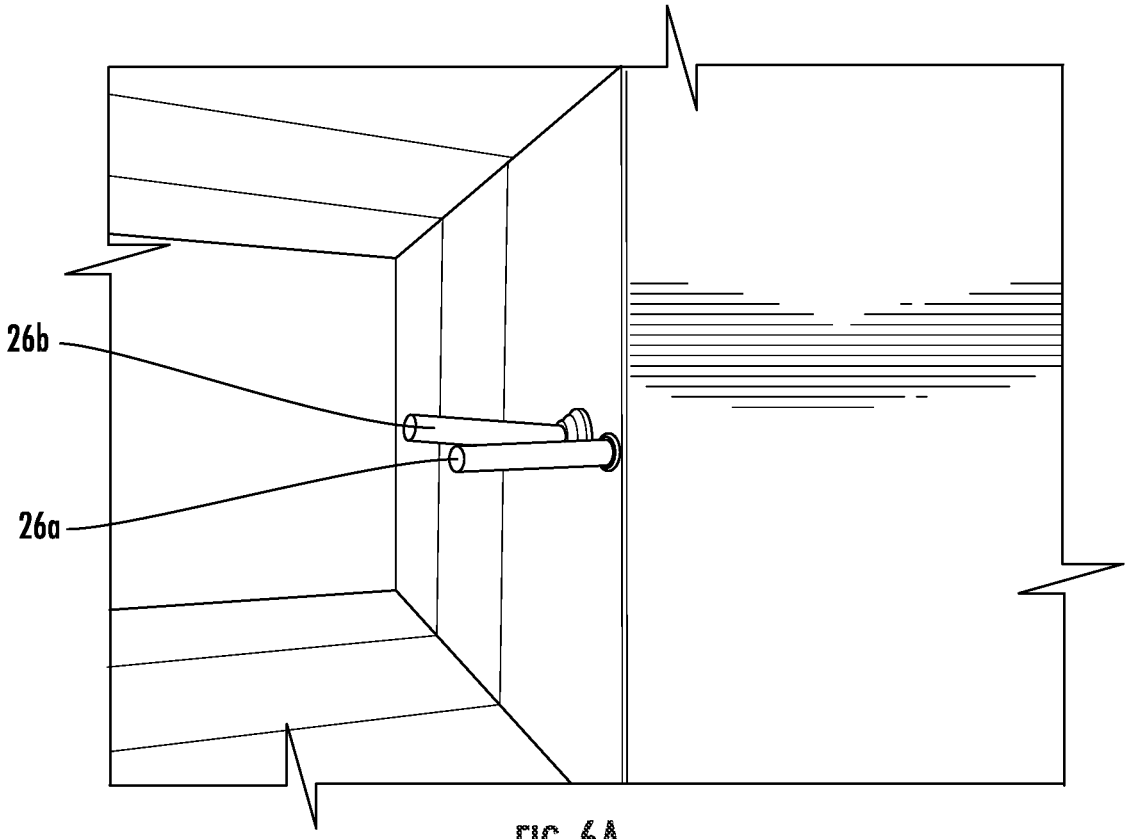
FIGS. 6A-6F illustrate diffusers for the hot and cold air integrated within a duct system adjacent to a vent or register.
Figure 6B:
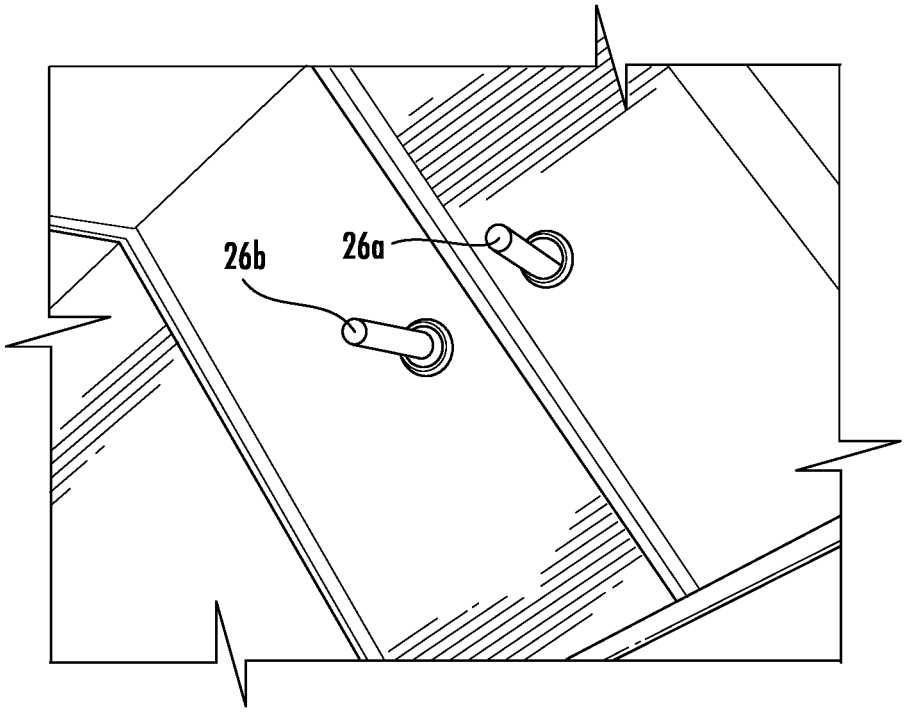
Figure 6C:
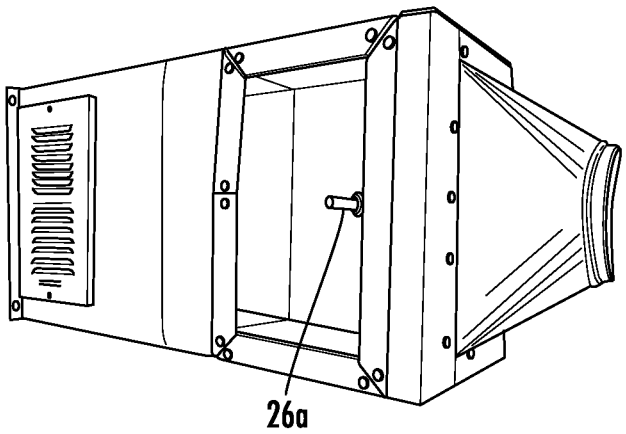
Figure 6D:
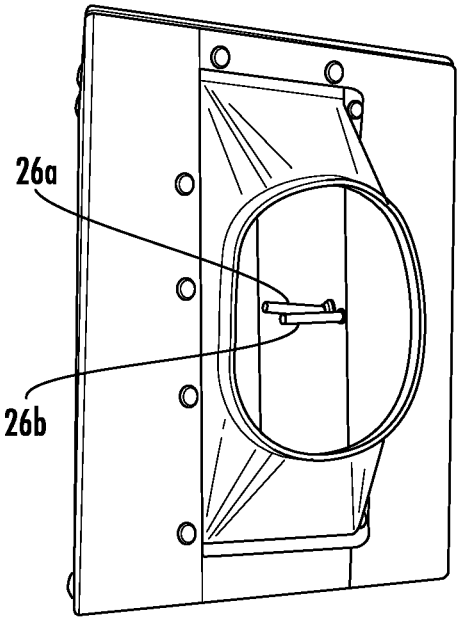
Figure 6E:
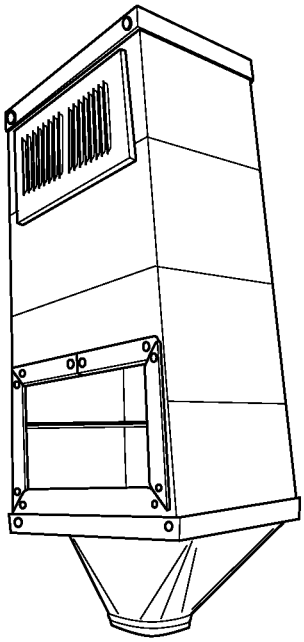
Figure 6F:
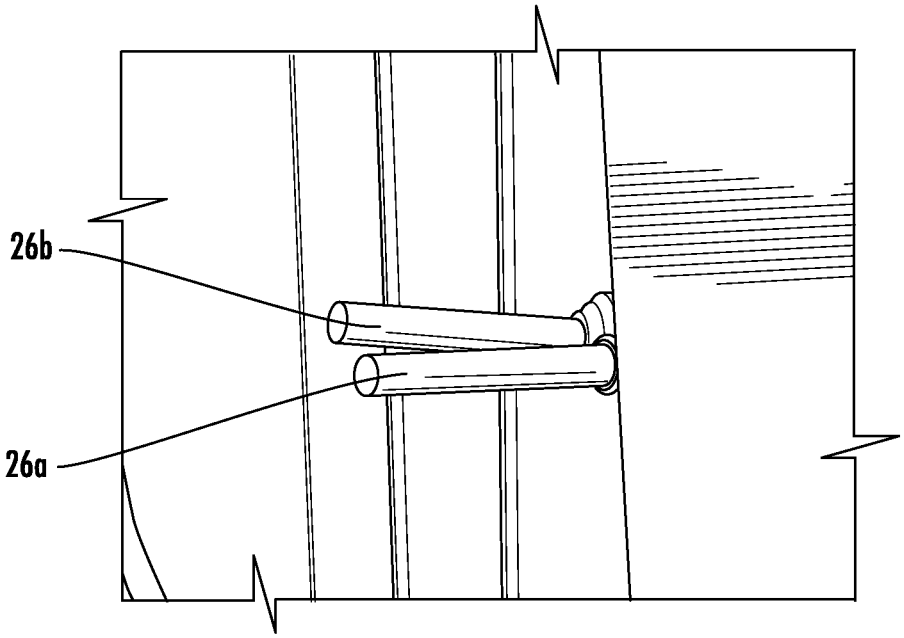

FIG. 5B illustrates another view of the floor plan from FIG. 5A. As shown in FIG. 5B, a duct system 100 is provided that includes a central fan 102 for circulating air through the duct system 100. Registers 104 are provided in each of the main areas of the house.

FIGS. 6A-6F illustrate diffusers 26*a*, 26*b* for the hot and cold air integrated within a duct system adjacent to a vent or register 104. As shown in FIGS. 6A-6F, the diffusers 26*a*, 26*b* can include a pipe or tube that extends into space defined by the duct. The diffusers 26*a*, 26*b* can include outlets which can be formed as transverse holes in the pipes. The diffusers 26*a*, 26*b* can be configured to distribute air at 2 psi-5 psi. This hot or cold air is then mixed with the ambient or circulating air in the duct system. A solenoid or valve can be configured to selectively provide air to either one of the diffusers. In one aspect, diffuser 26*a* is the hot air diffuser, and diffuser 26*b* is the cold air diffuser.

FIG. 7 illustrates one aspect of the system including both a heating system and cooling system integrated for use with a single dwelling. FIG. 7 is a schematic figure and generally shows connections (i.e. electrical, fluid, or otherwise) via dashed lines. One of ordinary skill in the art would understand that other connections can be provided between components that are not specifically illustrated. The heating system 10 and cooling system 110 can be arranged in parallel with each other and can be placed outside of the dwelling. One of ordinary skill in the art would understand that the systems could be implemented inside of the dwelling. In one aspect, the heating and cooling systems 10, 110 utilize a common compressor 14. Likewise, a common drying unit 15 can also be provided for both systems. In one aspect, a common power source 18 can be provided to power or energize the heating unit or element 16 in the system 10 and the cooling unit or element 116 in the system 110. Both systems 10, 110 can include a sensor 17 that is configured to detect temperatures within the tanks 12. The sensor 17 can be in communication with the heating and cooling units 16, 116, as well as elements of a control system, such as thermostat (i.e. thermostats 34*a*, 34*b*, 34*c*, 34*d*). The thermostats 34*a*, 34*b*, 34*c*, 34*d* can each be configured to detect the temperature in rooms A, B, C, D, and then control the release of hot or cold air via the respective diffusers 26*a*, 26*b*.

In one aspect, a pressure regulator can be provided between the tanks 12 and the diffusers or air outlets. The pressure regulator 23 is shown schematically in FIGS. 1, 3, and 7. The pressure regulator 23 can be configured to both modulate any pressure fluctuations from the tanks 12, and also provide a constant predetermined outlet pressure. The pressure regulator 23 can include at least one gauge 23*a*, 23*b*, that can indicate the pressure being supplied to the tubes or pipes exiting the tanks 12 and directed to the diffusers. A user can manually adjust the gauges 23*a*, 23*b* to manually set the outlet pressure for the regulator 23. In one aspect, the pressure regulator 23 can reduce the high pressure from the tanks 12 (i.e. approximately 150 psi) to a lower pressure (i.e. approximately 2-5 psi, or 1-2 psi) as the heated and cooled air is directed to the diffusers. In one aspect, the pressure regulator 23 is configured to lower pressure, or to control pressure between a first conduit and a second conduit.

Figure 8:
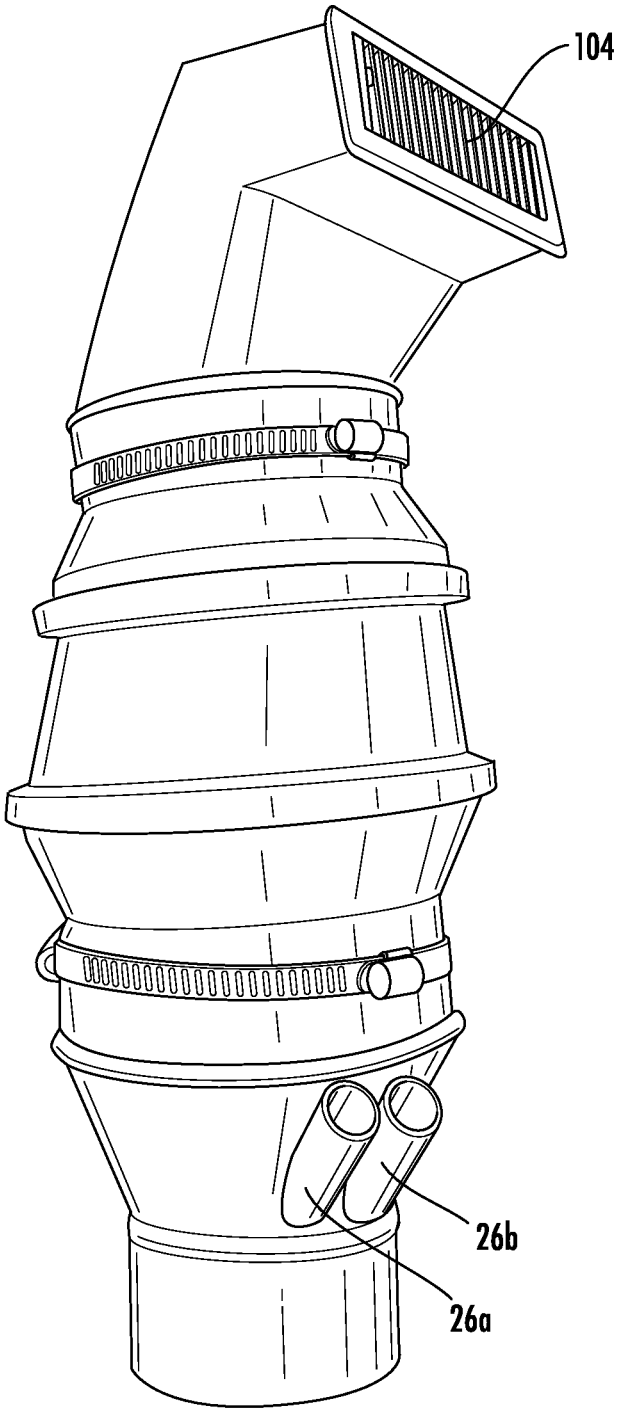
FIG. 8 illustrates a portion of a vent system including diffusers and a register.

FIG. 8 illustrates one exemplary duct system including the diffusers 26*a*, 26*b* and a register 104.

Figure 9A:
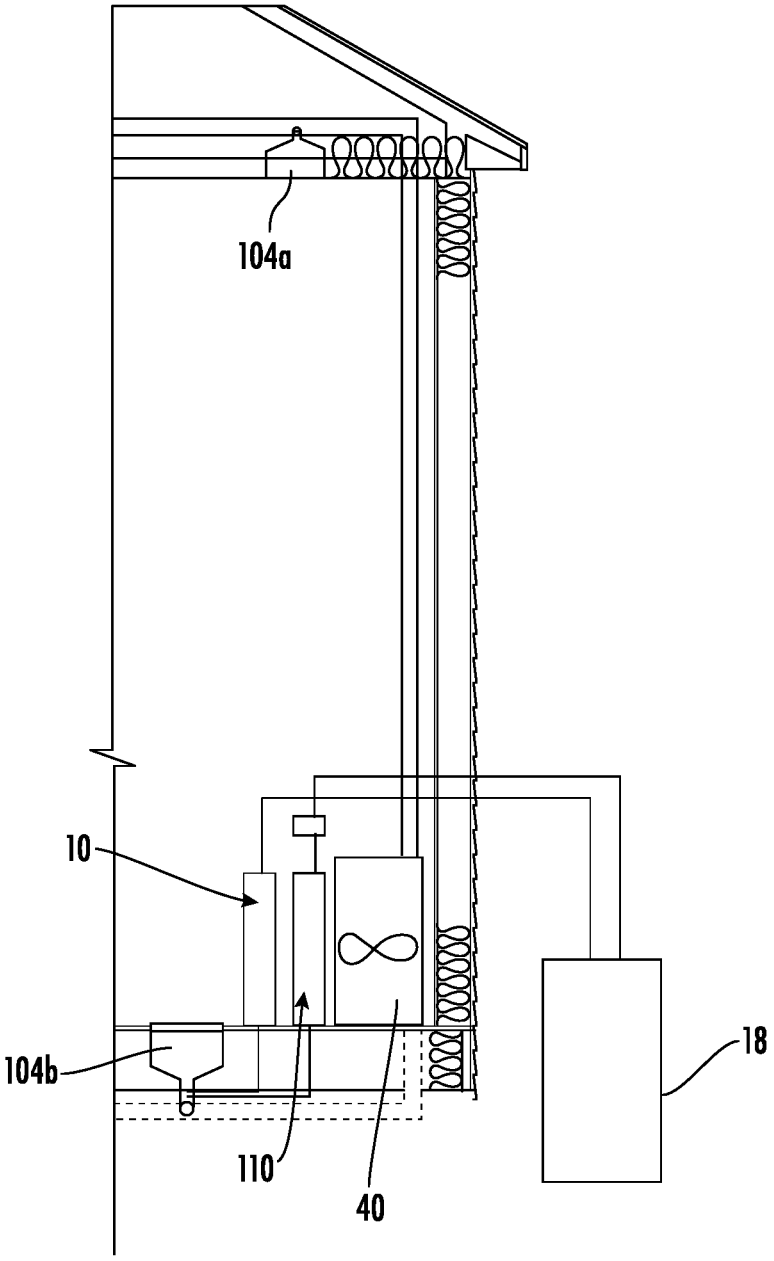
FIGS. 9A-9C illustrate schematic floorplans for configurations using a heating and cooling system.
Figure 9B:
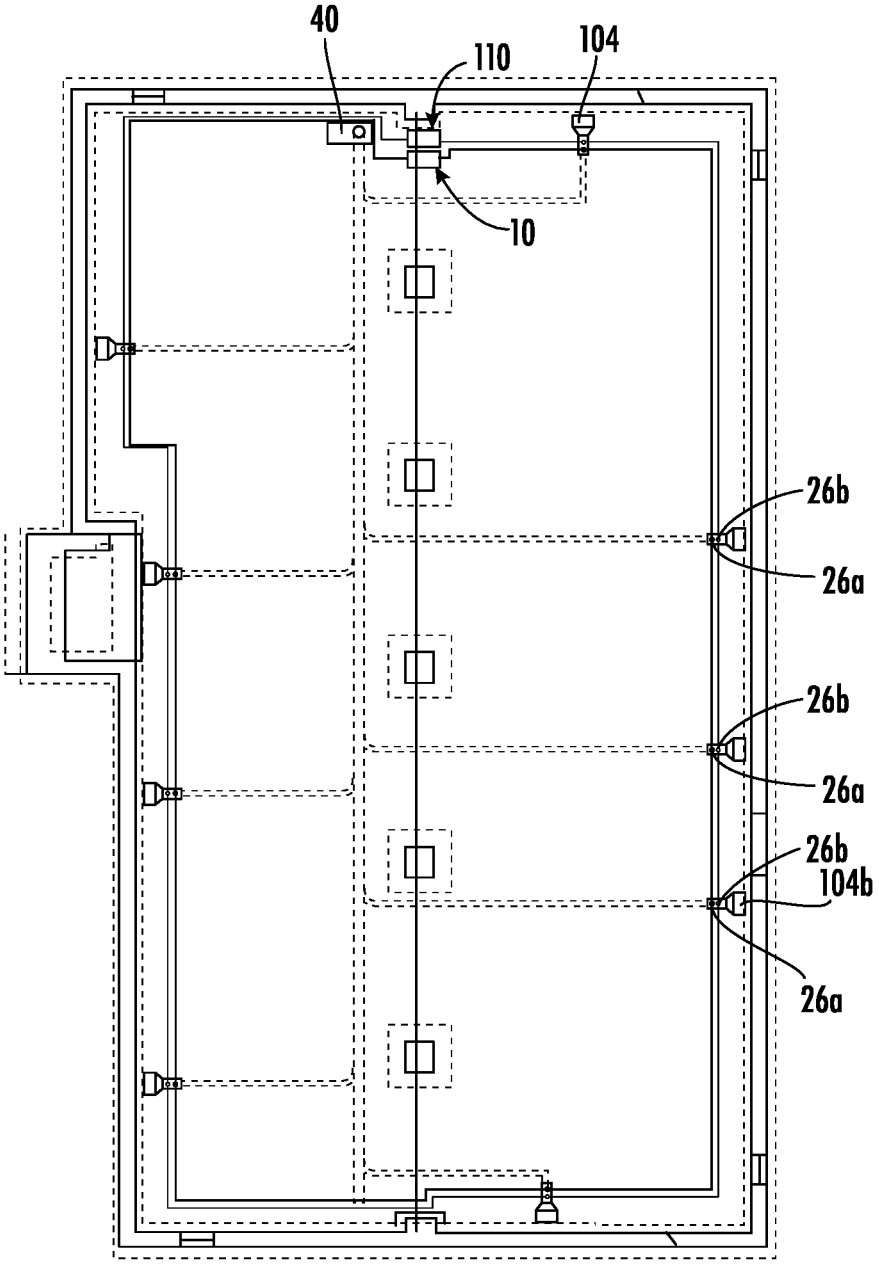
Figure 9C:
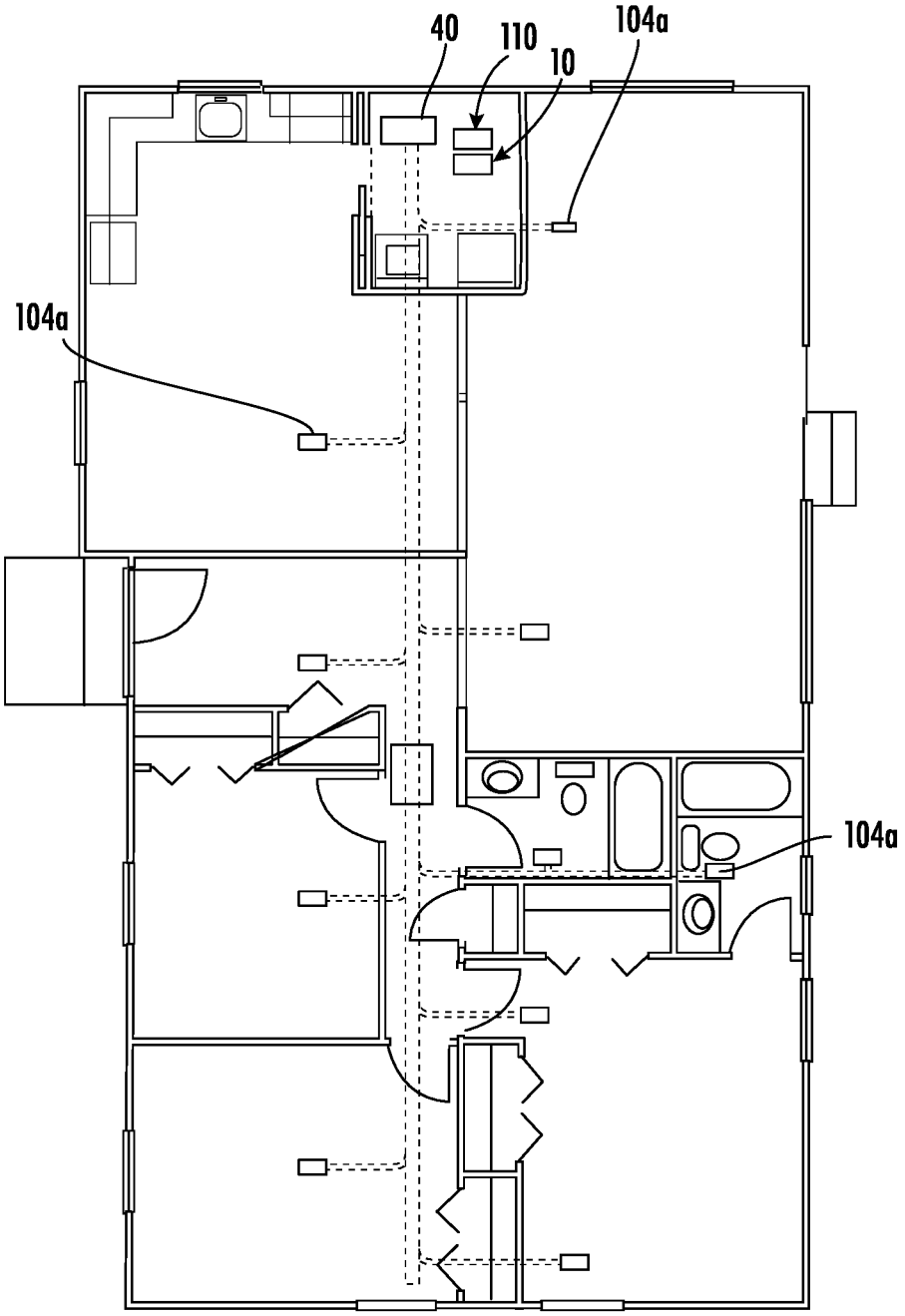

FIGS. 9A-9C illustrate various schematic floorplans for different systems that implement the heating and cooling systems disclosed herein. As shown in FIGS. 9A-9C, a ceiling register 104*a* can be provided to receive air and a floor register 104*b* can be provided to direct ambient air from the fan 40 throughout each room. In one aspect, the diffusers 26*a*, 26*b* can be provided adjacent to one of the registers, such as registers 104*b* as shown in FIG. 9B. In one aspect, ducts can be provided between the registers 104*a*, 104*b* and the fan 40 such that a continuous air circuit is provided throughout the dwelling. As shown in FIG. 9A, a common power supply or source 18 can be provided for both systems 10, 110.

Each system 10, 110 includes a plurality of conduits or pipes 24 that are distributed to a plurality of spaces or rooms within the dwelling. Multiple registers 104 can be provided within the dwelling structure. Additionally, a fan 40 can also be implemented to provide a lower power ventilation system. The systems 10, 110 implemented with the dwelling are each respectively configured to generate very hot or very cold air, respectively. Diffusers 26*a* are provided to selectively distribute hot air to the dwelling rooms A, B, C, D based on user demands or based on a detected temperature within the rooms. Diffusers 26*b* are similarly provided to selectively distribute very cold air to the dwelling rooms A, B, C, D based on user demands or based on a detected temperature within the rooms. FIG. 7 is a schematic figure and further details, such as coils 21, conduits or tubing 20, 22, inlet 28, outlet 30, etc. are not specifically shown, although one of ordinary skill in the art would understand that these elements can be provided in this aspect.

In one aspect, a single compressor can be provided for both the heating and cooling tanks. The compressor can have a capacity of 500 psi. In one aspect, the system disclosed herein can provide heating and cooling air for rooms within a house. The system disclosed herein can also be configured to provide high heat compressed air to a kitchen range, hot water heater, clothes dryer, or any other appliance or unit that requires high regulated heat. Additionally, the system can be configured to supply very cold air to appliances or units, such as refrigerators, freezers, etc. The control system can be configured to selectively provide hot or cold air either to a duct system directed to rooms in a house, and appliances that require hot or cold air. In this way, a single system can be used to both heat and cool a house and provide the requisite hot or cold air to respective appliances.

Having thus described various embodiments of the present invention in detail, it is to be appreciated and will be apparent to those skilled in the art that many changes, only a few of which are exemplified in the detailed description above, could be made without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A temperature control system comprising:

a compressor;

a first tank connected to the compressor, and a second tank connected to the compressor, the first and second tanks being separate from each other;

a heating element configured to heat air within the first tank, wherein the heating element is configured to be heated to at least 350° F.-700° F.;

a cooling element configured to cool air within the second tank, wherein the cooling element is configured to be cooled to at least −40° F.;

a plurality of conduits configured to deliver air from the first tank and the second tank to a respective plurality of diffusers; and a control assembly configured to selectively release air from the plurality of diffusers.

2. The system according to claim 1, wherein the control assembly includes at least one thermostat and a plurality of solenoids, and the plurality of solenoids are configured to be selectively driven between an open position and a closed position based on a temperature detected by the at least one thermostat.

3. The system according to claim 1, wherein the heating element comprises at least one electrical coil heater.

4. The system according to claim 1, wherein the cooling element comprises a cryocooler.

5. The system according to claim 1, further comprising a drying unit configured to remove moisture from the air within at least one of the first tank or the second tank.

6. The system according to claim 1, wherein the plurality of diffusers are arranged adjacent to at least one vent or register in a dwelling.

7. The system according claim 1, wherein hot pressurized air is configured to be stored within the first tank and a first set of conduits of the plurality of conduits arranged between the first tank and the plurality of diffusers, and cold pressurized air is configured to be stored within the second tank and a second set of conduits of the plurality of conduits arranged between the second tank and the plurality of diffusers.

8. The system according to claim 1, wherein the compressor is configured to pressurize air within the first and second tanks to at least 150 psi.

9. The system according to claim 1, wherein the control assembly is configured to automatically open a plurality of solenoids based on at least one thermostat detecting a temperature that is greater than or less than a predetermined temperature threshold.

10. The system according to claim 1, further comprising a first sensor arranged in the first tank and a second sensor arranged in the second tank, wherein the first and second sensors are each configured to detect pressure and temperature of air within the first and second tanks.

11. The system according to claim 1, wherein air being released from the plurality of diffusers is at 2-5 psi.

12. The system according to claim 1, wherein the first and second tanks comprise ceramic coated vessels.

13. The system according to claim 1, wherein air being released from the plurality of diffusers is within 5° F.-10° F. of a detected ambient temperature.

14. The system according to claim 1, wherein a first set of diffusers of the plurality of diffusers are configured to only distribute hot air from the first tank, and a second set of diffusers of the plurality of diffusers are configured to only distribute cold air from the second tank.

15. The system according to claim 14, wherein the first set of diffusers and the second set of diffusers are arranged adjacent to each other within a vent.

16. The system according to claim 1, wherein the cooling element comprises a cryocooler that is configured to be cooled to at least −40° F., the heating element comprises at least one electrically powered heating coil that is configured to be heated to at least 350° F.-700° F., and the compressor is configured to pressurize air within the first and second tanks to at least 150 psi.

17. The system according to claim 1, further comprising at least one pressure regulator configured to adjust the pressure of air exiting the first and second tanks and being directed through the plurality of conduits.

18. A temperature control system comprising:

a compressor;

a first tank connected to the compressor, and a second tank connected to the compressor, wherein the first tank and the second tank are separate from each other;

a heating element configured to heat air within the first tank to at least 350° F.-700° F.;

a cooling element configured to cool air within the second tank to at least −40° F.;

a plurality of conduits configured to deliver air from the first tank and the second tank to a respective plurality of diffusers, wherein the plurality of conduits each include insulation;

at least one pressure regulator configured to adjust pressure exiting the first and second tanks and directed through the plurality of conduits; and a control assembly configured to selectively open a plurality of solenoids based on at least one thermostat detecting a temperature that is greater than or less than a predetermined temperature threshold such that the plurality of solenoids release air from the plurality of diffusers, wherein the compressor is configured to pressurize air within the first and second tanks to at least 150 psi.

* * * * *